US010909993B2

(12) United States Patent
Choo et al.

(10) Patent No.: US 10,909,993 B2
(45) **Date of Patent: *Feb. 2, 2021**

(54) HIGH-BAND ENCODING METHOD AND DEVICE, AND HIGH-BAND DECODING METHOD AND DEVICE

(71) Applicant: SAMSUNG ELECTRONICS CO., LTD., Suwon-si (KR)

(72) Inventors: Ki-hyun Choo, Seoul (KR); Eun-mi Oh, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 16/592,876

(22) Filed: Oct. 4, 2019

(65) Prior Publication Data

US 2020/0035250 A1 Jan. 30, 2020

Related U.S. Application Data

(63) Continuation of application No. 15/129,184, filed as application No. PCT/IB2015/001365 on Mar. 24, 2015, now Pat. No. 10,468,035.

(Continued)

(51) Int. Cl.
*G10L 19/00* (2013.01)
*G10L 21/00* (2013.01)

(Continued)

(52) U.S. Cl.
CPC ..... *G10L 19/002* (2013.01); *G10L 19/02* (2013.01); *G10L 19/0204* (2013.01); *G10L 21/038* (2013.01)

(58) Field of Classification Search
CPC . G10L 19/002; G10L 19/0204; G10L 19/032; G10L 19/24; G10L 19/0208; G10L 21/038

See application file for complete search history.

(56) References Cited

U.S. PATENT DOCUMENTS 8,386,266 B2 2/2013 Feng et al.
8,392,198 B1 3/2013 Berisha et al.

(Continued)

FOREIGN PATENT DOCUMENTS

CA 2838170 A1 12/2012
CN 101609674 A 12/2009

(Continued)

OTHER PUBLICATIONS

"5.3 MDCT Coding Mode", 3rd Generation Partnership Project (3GPP), Mobile Competence Center, vol. SA WG4 Mar. 19, 2015, pp. 270-409 (140 pages total).

(Continued)

*Primary Examiner* — Olujimi A Adesanya
(74) *Attorney, Agent, or Firm* — Sughrue Mion, PLLC

(57) ABSTRACT

A high-band encoding/decoding method and device for bandwidth extension are provided. A high-band encoding method comprising the steps of: generating sub band-specific bit allocation information on the basis of a low-band envelope; determining, on the basis of the sub band-specific bit allocation information, the sub band requiring an envelope update in a high band; and generating, for the determined sub band, refinement data relating to the envelope update. A high-band decoding method comprising the steps of: generating sub band-specific bit allocation information on the basis of a low-band envelope; determining, on the basis of the sub band-specific bit allocation information, the sub band requiring an envelope update in a high band; and decoding, for the determined sub band, refinement data relating to the envelope update, thereby updating the envelope.

11 Claims, 15 Drawing Sheets

Related U.S. Application Data

(60) Provisional application No. 62/029,718, filed on Jul. 28, 2014, provisional application No. 61/969,368, filed on Mar. 24, 2014.

(51) Int. Cl.

| | |
|---|---|
| ***G10L 21/04*** | (2013.01) |
| ***G10L 19/002*** | (2013.01) |
| ***G10L 19/02*** | (2013.01) |
| ***G10L 21/038*** | (2013.01) |

(56) References Cited

U.S. PATENT DOCUMENTS

| | | | | |
|---|---|---|---|---|
| 8,392,202 | B2 * | 3/2013 | Taleb | G10L 19/022 704/503 |
| 8,606,586 | B2 | 12/2013 | Nagel et al. | |
| 8,694,325 | B2 | 4/2014 | Lin et al. | |
| 8,706,511 | B2 | 4/2014 | Taleb | |
| 8,874,450 | B2 | 10/2014 | Peng et al. | |
| 10,134,402 | B2 | 11/2018 | Zhou et al. | |
| 2002/0087304 | A1 | 7/2002 | Kjorling et al. | |
| 2005/0163323 | A1 | 7/2005 | Oshikiri | |
| 2008/0071550 | A1 | 3/2008 | Oh et al. | |
| 2010/0070269 | A1 | 3/2010 | Gao | |
| 2010/0121646 | A1 | 5/2010 | Ragot et al. | |
| 2011/0106529 | A1 * | 5/2011 | Disch | G10L 19/20 704/205 |
| 2012/0158409 | A1 | 6/2012 | Nagel et al. | |
| 2012/0226505 | A1 | 9/2012 | Lin et al. | |
| 2012/0259644 | A1 | 10/2012 | Lin et al. | |
| 2012/0323582 | A1 | 12/2012 | Peng et al. | |
| 2013/0173275 | A1 | 7/2013 | Liu et al. | |
| 2013/0290003 | A1 | 10/2013 | Choo | |
| 2013/0339038 | A1 * | 12/2013 | Norvell | G10L 19/0204 704/500 |
| 2014/0142957 | A1 | 5/2014 | Sung et al. | |
| 2014/0188464 | A1 | 7/2014 | Choo | |
| 2014/0200901 | A1 | 7/2014 | Kawashima et al. | |
| 2014/0257827 | A1 | 9/2014 | Norvell et al. | |
| 2014/0303965 | A1 | 10/2014 | Lee et al. | |
| 2015/0142452 | A1 | 5/2015 | Sung et al. | |

FOREIGN PATENT DOCUMENTS

| | | | |
|---|---|---|---|
| CN | 101878504 | A | 11/2010 |
| CN | 102081927 | A | 6/2011 |
| CN | 102222505 | A | 10/2011 |
| CN | 102473414 | A | 5/2012 |
| EP | 0176243 | A2 | 4/1986 |
| EP | 2482052 | A1 | 8/2012 |
| EP | 3174050 | A1 | 5/2017 |
| JP | 2013-511054 | A | 3/2013 |
| KR | 10-0517229 | B1 | 9/2005 |
| KR | 10-1346358 | B1 | 12/2013 |
| KR | 10-2015-0103643 | A | 9/2015 |
| WO | 2009/029032 | A2 | 3/2009 |
| WO | 2011063694 | A1 | 6/2011 |
| WO | 2012165910 | A2 | 12/2012 |
| WO | 2012165910 | A3 | 12/2012 |
| WO | 2013/002623 | A2 | 1/2013 |
| WO | 2013035257 | A1 | 3/2013 |
| WO | 2013/062392 | A1 | 5/2013 |

OTHER PUBLICATIONS

"6.2 MDCT Coding mode decoding", 3rd Generation Partnership Project (3GPP), Mobile Competence Center, vol. SA WG4, Mar. 19, 2015, pp. 520-606 (87 pages total).

Communication dated Oct. 2, 2017, by the European Patent Office in counterpart European Application No. 15783391.4.

Communication dated Feb. 26, 2019 issued by the Japanese Patent Office in counterpart Japanese Application No. 2016-558776.

International Search Report and Written Opinion, issued by International Searching Authority in corresponding International Application No. PCT/IB2015/001365, dated Dec. 14, 2015, (PCT/ISA/210 & PCT/ISA/237).

Communication dated Aug. 23, 2018, issued by the European Patent Office in counterpart European Application No. 15783391.4.

ETSI TS 126 445 V12.0.0, Universal Mobile Telecommunications System (UMTS); LTE; EVS Codec Detailed Algorithmic Description, Nov. 2014, (3GPP TS 26.445 version 12.0.0 Release 12), pp. 1-627.

G.729-based embedded variable bit-rate coder: An 8-32 kbit/s scalable wideband coder bitstream interoperable with G.729, 2006, pp. 1-100.

Communication dated Mar. 14, 2019, issued by the State Intellectual Property Office of P.R. China in counterpart Chinese Application No. 201580027514.9.

* cited by examiner

HIGH-BAND ENCODING METHOD AND DEVICE, AND HIGH-BAND DECODING METHOD AND DEVICE

CROSS-REFERENCE TO RELATED APPLICATIONS

This application is a continuation application of U.S. patent application Ser. No. 15/129,184 filed on Sep. 26, 2016, which is a National Stage Entry of International Application No. PCT/IB2015/001365 filed on Mar. 24, 2015, which claims the benefit of U.S. Provisional Application No. 62/029,718 filed on Jul. 28, 2014, and U.S. Provisional Application No. 61/969,368 filed on Mar. 24, 2014, the disclosures of which are incorporated herein by reference in their entireties.

TECHNICAL FIELD

One or more exemplary embodiments relate to audio encoding and decoding, and more particularly, to a method and apparatus for high band coding and a method and apparatus for high band decoding, for bandwidth extension (BWE).

BACKGROUND ART

The coding scheme in G.719 has been developed and standardized for videoconferencing. According to this scheme, a frequency domain transform is performed via a modified discrete cosine transform (MDCT) to directly code an MDCT spectrum for a stationary frame and to change a time domain aliasing order for a non-stationary frame so as to consider temporal characteristics. A spectrum obtained for a non-stationary frame may be constructed in a similar form to a stationary frame by performing interleaving to construct a codec with the same framework as the stationary frame. The energy of the constructed spectrum is obtained, normalized, and quantized. In general, the energy is represented as a root mean square (RMS) value, and bits required for each band is obtained from a normalized spectrum through energy-based bit allocation, and a bitstream is generated through quantization and lossless coding based on information about the bit allocation for each band.

According to the decoding scheme in G.719, in a reverse process of the coding scheme, a normalized dequantized spectrum is generated by dequantizing energy from a bitstream, generating bit allocation information based on the dequantized energy, and dequantizing a spectrum based on the bit allocation information. When the bits is insufficient, a dequantized spectrum may not exist in a specific band. To generate noise for the specific band, a noise filling method for generating a noise codebook based on a dequantized low frequency spectrum and generating noise according to a transmitted noise level is applied.

For a band of a specific frequency or higher, a bandwidth extension scheme for generating a high frequency signal by folding a low frequency signal is applied.

DISCLOSURE

Technical Problems

One or more exemplary embodiments provide a method and an apparatus for high band coding, and a method and an apparatus for high band decoding for bandwidth extension (BWE), by which the sound quality of a reconstructed signal may be improved, and a multimedia apparatus employing the same.

Technical Solution

According to one or more exemplary embodiments, a high band coding method includes generating bit allocation information for each sub-band, based on an envelope of a full band, determining a sub-band for which it is necessary to update an envelope in a high band, based on the bit allocation information for each sub-band, and generating refinement data related to updating the envelope for the determined sub-band.

According to one or more exemplary embodiments, a high band coding apparatus includes at least one processor configured to generate bit allocation information for each sub-band, based on an envelope of a full band, determine a sub-band for which it is necessary to update an envelope in a high band, based on the bit allocation information for each sub-band, and generate refinement data related to updating the envelope for the determined sub-band.

According to one or more exemplary embodiments, a high band decoding method includes generating bit allocation information for each sub-band, based on an envelope of a full band, determining a sub-band for which it is necessary to update an envelope in a high band, based on the bit allocation information for each sub-band, and updating the envelope by decoding refinement data related to updating the envelope for the determined sub-band.

According to one or more exemplary embodiments, a high band decoding apparatus includes at least one processor configured to generate bit allocation information for each sub-band, based on an envelope of a full band, determine a sub-band for which it is necessary to update an envelope in a high band, based on the bit allocation information for each sub-band, and update the envelope by decoding refinement data related to updating the envelope for the determined sub-band.

Advantageous Effects

According to one or more exemplary embodiments, for at least one sub-band including important spectral information in a high band, information corresponding to a norm thereof is represented, thereby improving the sound quality of a reconstructed signal.

DESCRIPTION OF DRAWINGS

These and/or other aspects will become apparent and more readily appreciated from the following description of the exemplary embodiments, taken in conjunction with the accompanying drawings in which.

MODE FOR INVENTION

Figure 1:
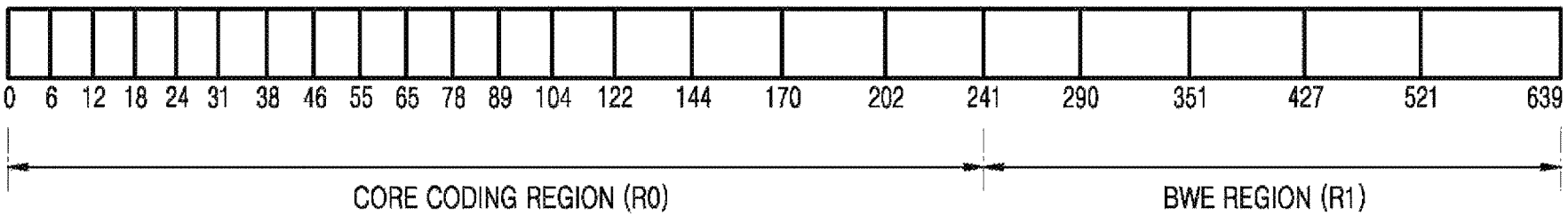
FIG. 1 illustrates respective configurations of sub-bands in a low band and sub-bands in a high band, according to an exemplary embodiment.

The present inventive concept may allow various changes or modifications in form, and specific exemplary embodiments will be illustrated in the drawings and described in detail in the specification. However, this is not intended to limit the present inventive concept to particular modes of practice, and it is to be appreciated that all changes, equivalents, and substitutes that do not depart from the technical spirit and technical scope of the present inventive concept are encompassed by the present inventive concept. In the specification, certain detailed explanations of the related art are omitted when it is deemed that they may unnecessarily obscure the essence of the present invention.

While the terms including an ordinal number, such as "first", "second", etc., may be used to describe various components, such components are not be limited by theses terms. The terms first and second should not be used to attach any order of importance but are used to distinguish one element from another element.

The terms used in the specification are merely used to describe particular embodiments, and are not intended to limit the scope of the present invention. Although general terms widely used in the present specification were selected for describing the present disclosure in consideration of the functions thereof, these general terms may vary according to intentions of one of ordinary skill in the art, case precedents, the advent of new technologies, or the like. Terms arbitrarily selected by the applicant of the present invention may also be used in a specific case. In this case, their meanings need to be given in the detailed description of the invention. Hence, the terms must be defined based on their meanings and the contents of the entire specification, not by simply stating the terms.

An expression used in the singular encompasses the expression in the plural, unless it has a clearly different meaning in the context. In the specification, it is to be understood that terms such as "including," "having," and "comprising" are intended to indicate the existence of the features, numbers, steps, actions, components, parts, or combinations thereof disclosed in the specification, and are not intended to preclude the possibility that one or more other features, numbers, steps, actions, components, parts, or combinations thereof may exist or may be added.

One or more exemplary embodiments will now be described more fully hereinafter with reference to the accompanying drawings. In the drawings, like elements are denoted by like reference numerals, and repeated explanations thereof will not be given.

FIG. 1 illustrates respective configurations of sub-bands in a low band and sub-bands in a high band, according to an exemplary embodiment. According to an embodiment, a sampling rate is 32 KHz, and 640 modified discrete cosine transform (MDCT) spectral coefficients may be formed by 22 bands, more specifically, 17 bands of the low band and 5 bands of the high band. For example, a start frequency of the high band is a $241^{st}$ spectral coefficient, and $0^{th}$ to $240^{th}$ spectral coefficients may be defined as R0, that is, a region to be coded in a low frequency coding scheme, namely, a core coding scheme. In addition, $241^{st}$ to $639^{th}$ spectral coefficients may be defined as R1, that is, a high band for which bandwidth extension (BWE) is performed. In the region R1, a band to be coded in a low frequency coding scheme according to bit allocation information may also exist.

Figure 2A:
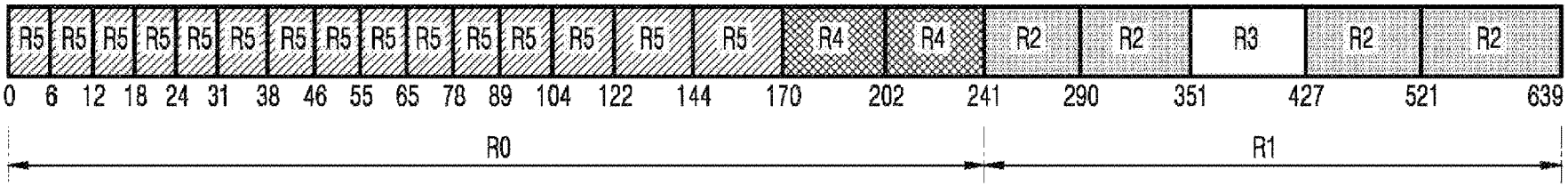
FIGS. 2A-2C illustrate division of a region R0 and a region R1 into R4 and R5, and R2 and R3, respectively, according to selected coding schemes, according to an exemplary embodiment.
Figure 2B:
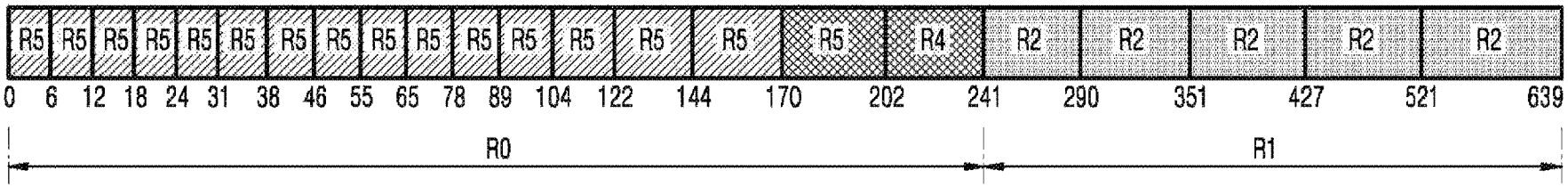
Figure 2C:
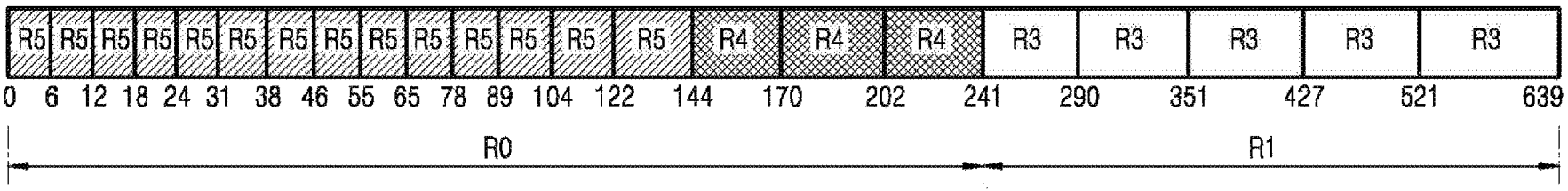

FIGS. 2A-2C illustrate division of the region R0 and the region R1 of FIG. 1 into R4 and R5, and R2 and R3, respectively, according to selected coding schemes. The region R1, which is a BWE region, may be divided into R2 and R3, and the region R0, which is a low frequency coding region, may be divided into R4 and R5. R2 indicates a band containing a signal to be quantized and lossless-coded in a low frequency coding scheme, e.g., a frequency domain coding scheme, and R3 indicates a band in which there are no signals to be coded in a low frequency coding scheme. However, even when it is determined that R2 is a band to which bits are allocated and which is coded in a low frequency coding scheme, when bits is insufficient, R2 may generate a band in the same way as R3. R5 indicates a band for which a low frequency coding scheme via allocated bits is performed, and R4 indicates a band for which coding cannot be performed even for a low frequency signal due to no extra bits or noise should be added due to less allocated bits. Thus, R4 and R5 may be identified by determining whether noise is added, wherein the determination may be performed by a percentage of the number of spectrums in a low-frequency-coded band, or may be performed based on in-band pulse allocation information when factorial pulse coding (FPC) is used. Since the bands R4 and R5 can be identified when noise is added thereto in a decoding process, the bands R4 and R5 may not be clearly identified in an encoding process. The bands R2 to R5 may have mutually different information to be encoded, and also, different decoding schemes may be applied to the bands R2 to R5.

In the illustration shown in FIG. 2A, two bands containing $170^{th}$ to $240^{th}$ spectral coefficients in the low frequency coding region R0 are R4 to which noise is added, and two bands containing $241^{st}$ to $350^{th}$ spectral coefficients and two bands containing $427^{th}$ to $639^{th}$ spectral coefficients in the BWE region R1 are R2 to be coded in a low frequency coding scheme. In the illustration shown in FIG. 2B, one band containing $202^{nd}$ to $240^{th}$ spectral coefficients in the low frequency coding region R0 is R4 to which noise is added, and all the five bands containing $241^{st}$ to $639^{th}$ spectral coefficients in the BWE region R1 are R2 to be coded in a low frequency coding scheme. In the illustration shown in FIG. 2C, three bands containing $144^{th}$ to $240^{th}$ spectral coefficients in the low frequency coding region R0 are R4 to which noise is added, and R2 does not exist in the BWE region R1. In general, R4 in the low frequency coding region R0 may be distributed in a high frequency band, and R2 in the BWE region R1 may not be limited to a specific frequency band.

Figure 3:
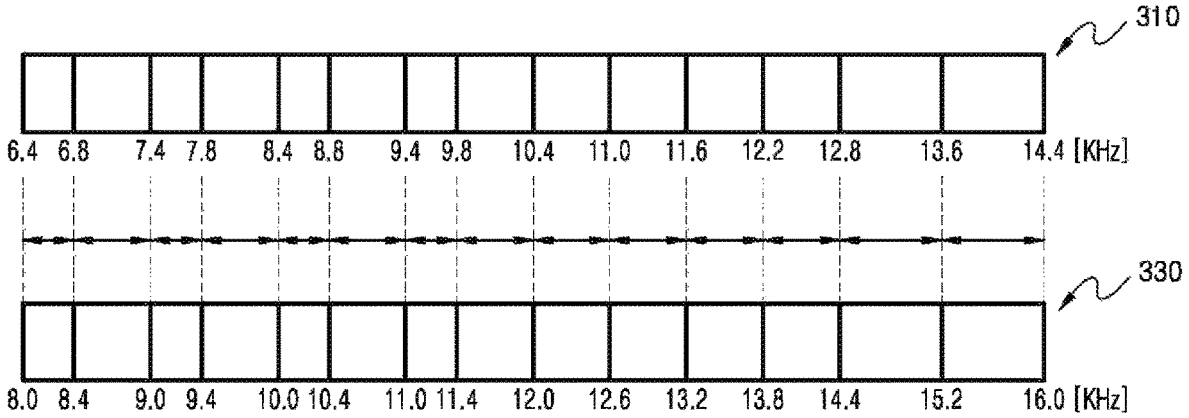
FIG. 3 illustrates a configuration of sub-bands in a high band, according to an exemplary embodiment.

FIG. 3 illustrates sub-bands of a high band in a wideband (WB), according to an embodiment. A sampling rate is 32 KHz, and a high band among 640 MDCT spectral coefficients may be formed by 14 bands. Four spectral coefficients may be included in a band of 100 Hz, and thus a first band of 400 Hz may include 16 spectral coefficients. Reference numeral 310 indicates a sub-band configuration of a high band of 6.4 to 14.4 KHz, and reference numeral 330 indicates a sub-band configuration of a high band of 8.0 to 16.0 KHz.

envelope and if necessary a delta between norms. The norm of the low band 410 may be scalar quantized and the envelope of the high band 430 may be vector quantized. For a sub-band 450 in which important spectral information is included, the delta between norms may be represented. For the low band, sub-bands may be constructed based on band division information $B_{fb}$ of a full band and for the high band, sub-bands may be constructed based on band division information $B_{hb}$ of a high band. The band division information $B_{fb}$ of the full band and the band division information $B_{hb}$ of the high band may be the same or may be different to each other. When the band division information $B_{fb}$ of the full band is different from the band division information $B_{hb}$ of the high band, norms of the high band may be represented through a mapping process.

Table 1 represents an example of a sub-band configuration of a low band according to the band division information $B_{fb}$ of the full band. The band division information $B_{fb}$ of the full band may be identical for all bitrates. In table, p denotes a sub-band index, Lp decotes a number of spectral coefficients in a sub-band, s, denotes a start frequency index of a sub-band, and $e_p$ denotes an end frequency index of a sub-band, respectively.

TABLE 1

| p | 0 | 1 | 2 | 3 | 4 | 5 | 6 | 7 | 8 | 9 | 10 | 11 | 12 | 13 | 14 | 15 |
|---|---|---|---|---|---|---|---|---|---|---|---|---|---|---|---|---|
| $L_p$ | 8 | 8 | 8 | 8 | 8 | 8 | 8 | 8 | 8 | 8 | 8 | 8 | 8 | 8 | 8 | 8 |
| $s_p$ | 0 | 8 | 16 | 24 | 32 | 40 | 48 | 56 | 64 | 72 | 80 | 88 | 96 | 104 | 112 | 120 |
| $e_p$ | 7 | 15 | 23 | 32 | 39 | 47 | 55 | 63 | 71 | 79 | 87 | 95 | 103 | 111 | 119 | 127 |
| p | 16 | 17 | 18 | 19 | 20 | 21 | 22 | 23 | | | | | | | | |
| $L_p$ | 16 | 16 | 16 | 16 | 16 | 16 | 16 | 16 | | | | | | | | |
| $s_p$ | 128 | 144 | 160 | 176 | 192 | 208 | 224 | 240 | | | | | | | | |
| $e_p$ | 143 | 159 | 175 | 191 | 207 | 223 | 239 | 255 | | | | | | | | |
| p | 24 | 25 | 26 | 27 | 28 | 29 | 30 | 31 | 32 | 33 | 34 | 35 | | | | |
| $L_p$ | 24 | 24 | 24 | 24 | 24 | 24 | 24 | 24 | 24 | 24 | 24 | 24 | | | | |
| $s_p$ | 256 | 280 | 304 | 328 | 352 | 376 | 400 | 424 | 448 | 472 | 496 | 520 | | | | |
| $e_p$ | 279 | 303 | 327 | 351 | 375 | 399 | 423 | 447 | 471 | 495 | 519 | 543 | | | | |
| p | 36 | 37 | 38 | 39 | 40 | 41 | 42 | 43 | | | | | | | | |
| $L_p$ | 32 | 32 | 32 | 32 | 32 | 32 | 32 | 32 | | | | | | | | |
| $s_p$ | 544 | 576 | 608 | 640 | 672 | 704 | 736 | 768 | | | | | | | | |
| $e_p$ | 574 | 607 | 639 | 671 | 703 | 735 | 767 | 799 | | | | | | | | |

According to an embodiment, when a spectrum of a full band is coded, a scale factor of a low band and a scale factor of a high band may be differently represented to each other. The scale factor may be represented by an energy, an envelope, an average power or a norm, etc. For example, from among the full band, in order to concisely represent the low band, the norm or the envelope of the low band may be obtained to then be scalar quantized and losslessly coded, and in order to efficiently represent the high band, the norm or the envelope of the high band may be obtained to then be vector quantized. For a sub-band in which important spectral information is included, information corresponding to the norm thereof may be represented by using a low frequency coding scheme. In addition, for a sub-band coded by using a low frequency coding scheme in the high band, refinement data for compensating for a norm of a high frequency band may be transmitted via a bitstream. As a result, meaningful spectral components in the high band may be exactly represented, thereby improving the sound quality of a reconstructed signal.

Figure 4:
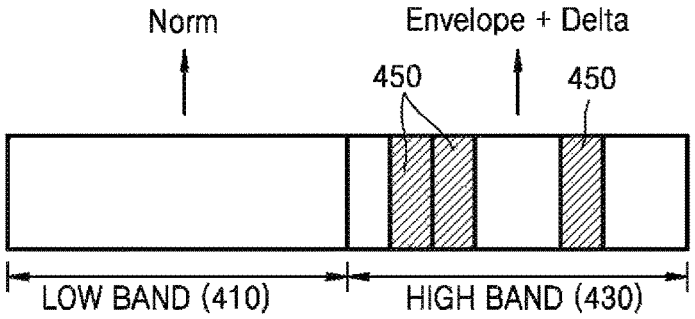
FIG. 4 illustrates a concept of a high band coding method, according to an exemplary embodiment.

FIG. 4 illustrates a method of representing a scale factor of a full band, according to an exemplary embodiment.

Referring to FIG. 4, a low band 410 may be represented by a norm and a high band 430 may be represented by an For each sub-band constructed as shown in table 1, a norm or a spectral energy may be calculated by using equation 1.

$$N(p) = \sqrt{\frac{1}{L_p} \sum_{k=s_p}^{e_p} y(k)^2} \quad \text{[Equation 1]}$$

Here, y(k) denotes a spectral coefficient which is obtained by a time-frequency transform, for example, a modified discrete cosine transform (MDCT) spectral coefficient.

An envelope may also be obtained in the same manner as the norm. The norms obtained for sub-bands depending on a band configuration may be defined as the envelope. The norm and the envelope may be used as an equivalent term.

The norm of a low band or the norm of a low frequency band may be scalar quantized and then losslessly coded. The scalar quantization of the norm may be performed by the following table 2.

TABLE 2

| Index | Code |
|---|---|
| 0 | $2^{17.0}$ |
| 1 | $2^{16.5}$ |
| 2 | $2^{16.0}$ |
| 3 | $2^{15.5}$ |
| 4 | $2^{15.0}$ |
| 5 | $2^{14.5}$ |
| 6 | $2^{14.0}$ |
| 7 | $2^{13.5}$ |
| 8 | $2^{13.0}$ |
| 9 | $2^{12.5}$ |
| 10 | $2^{12.0}$ |
| 11 | $2^{11.5}$ |
| 12 | $2^{11.0}$ |
| 13 | $2^{10.5}$ |
| 14 | $2^{10.0}$ |
| 15 | $2^{9.5}$ |
| 16 | $2^{9.0}$ |
| 17 | $2^{8.5}$ |
| 18 | $2^{8.0}$ |
| 19 | $2^{7.5}$ |
| 20 | $2^{7.0}$ |
| 21 | $2^{6.5}$ |
| 22 | $2^{6.0}$ |
| 23 | $2^{5.5}$ |
| 24 | $2^{5.0}$ |
| 25 | $2^{4.5}$ |
| 26 | $2^{4.0}$ |
| 27 | $2^{3.5}$ |
| 28 | $2^{3.0}$ |
| 29 | $2^{2.5}$ |
| 30 | $2^{2.0}$ |
| 31 | $2^{1.5}$ |
| 32 | $2^{1.0}$ |
| 33 | $2^{0.5}$ |
| 34 | $2^{0.0}$ |
| 35 | $2^{-0.5}$ |
| 36 | $2^{-1.0}$ |
| 37 | $2^{-1.5}$ |
| 38 | $2^{-2.0}$ |
| 39 | $2^{-2.5}$ |

The envelope of the high band may be vector quantized. The quantized envelope may be defined as $E_q(p)$.

Tables 3 and 4 represent a band configuration of a high band in cases of a bitrate 24.4 kbps and a bitrate 32 kbps, respectively.

TABLE 3

| p | 0 | 1 | 2 | 3 | 4 | 5 | 6 | 7 | 8 | 9 | 10 | 11 | 12 | 13 | 14 | 15 | 16 |
|---|---|---|---|---|---|---|---|---|---|---|---|---|---|---|---|---|---|
| $L_p$ | 16 | 24 | 16 | 24 | 16 | 24 | 16 | 24 | 24 | 24 | 24 | 24 | 32 | 32 | 40 | 40 | 80 |
| $s_p$ | 320 | 336 | 360 | 376 | 400 | 416 | 440 | 456 | 480 | 504 | 528 | 552 | 576 | 608 | 640 | 680 | 720 |
| $e_p$ | 335 | 359 | 375 | 399 | 415 | 439 | 455 | 479 | 503 | 527 | 551 | 575 | 607 | 639 | 679 | 719 | 799 |

TABLE 4

| p | 0 | 1 | 2 | 3 | 4 | 5 | 6 | 7 | 8 | 9 | 10 | 11 | 12 | 13 | 14 |
|---|---|---|---|---|---|---|---|---|---|---|---|---|---|---|---|
| $L_p$ | 16 | 24 | 16 | 24 | 16 | 24 | 16 | 24 | 24 | 24 | 24 | 24 | 40 | 40 | 80 |
| $s_p$ | 384 | 400 | 424 | 440 | 464 | 480 | 504 | 520 | 544 | 568 | 592 | 616 | 640 | 680 | 720 |
| $e_p$ | 399 | 423 | 439 | 463 | 479 | 503 | 519 | 543 | 567 | 591 | 615 | 639 | 679 | 719 | 799 |

Figure 5:
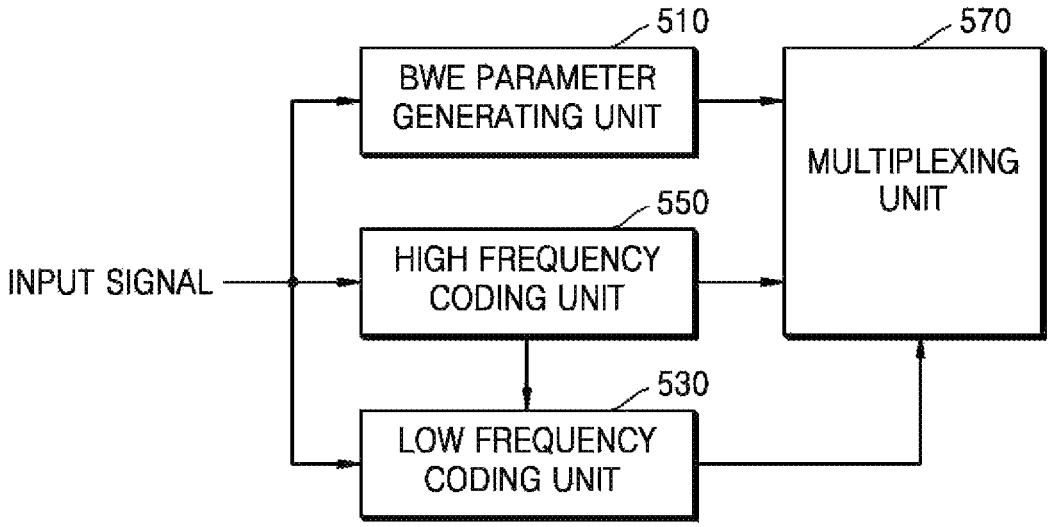
FIG. 5 is a block diagram of an audio coding apparatus according to an exemplary embodiment.

FIG. 5 is a block diagram of an audio coding apparatus according to an exemplary embodiment.

The audio coding apparatus of FIG. 5 may include a BWE parameter generating unit 510, a low frequency coding unit 530, a high frequency coding unit 550, and a multiplexing unit 570. The components may be integrated into at least one module and implemented by at least one processor (not shown). An input signal may indicate music, speech, or a mixed signal of music and speech and may be largely divided into a speech signal and another general signal. Hereinafter, the input signal is referred to as an audio signal for convenience of description.

Referring to FIG. 5, the BWE parameter generating unit 510 may generate a BWE parameter for bandwidth extension. The BWE parameter may correspond to an excitation class. According to an implementation scheme, the BWE parameter may include an excitation class and other parameters. The BWE parameter generating unit 510 may generate an excitation class in units of frames, based on signal characteristics. In detail, the BWE parameter generating unit 510 may determine whether an input signal has speech characteristics or tonal characteristics, and may determine one from among a plurality of excitation classes based on a result of the former determination. The plurality of excitation classes may include an excitation class related to speech, an excitation class related to tonal music, and an excitation class related to non-tonal music. The determined excitation class may be included in a bitstream and transmitted.

The low frequency coding unit 530 may encode a low band signal to generate an encoded spectral coefficient. The low frequency coding unit 530 may also encode information related to an energy of the low band signal. According to an embodiment, the low frequency coding unit 530 may transform the low band signal into a frequency domain signal to generate a low frequency spectrum, and may quantize the low frequency spectrum to generate a quantized spectral coefficient. MDCT may be used for the domain transform, but embodiments are not limited thereto. Pyramid vector quantization (PVQ) may be used for the quantization, but embodiments are not limited thereto.

The high frequency coding unit 550 may encode a high band signal to generate a parameter necessary for bandwidth extension or bit allocation in a decoder end. The parameter necessary for bandwidth extension may include information related to an energy of the high band signal and additional information. The energy may be represented as an envelope, a scale factor, an average power, or a norm of each band. The additional information may correspond to information about a band including an important spectral component in a high band, and may be information related to a spectral component included in a specific band of a high band. The high frequency coding unit 550 may generate a high frequency spectrum by transforming the high band signal into a frequency domain signal, and may quantize information related to the energy of the high frequency spectrum. MDCT may be used for the domain transform, but embodiments are not limited thereto. Vector quantization may be used for the quantization, but embodiments are not limited thereto.

The multiplexing unit 570 may generate a bitstream including the BWE parameter (i.e., the excitation class), the parameter necessary for bandwidth extension and the quantized spectral coefficient of a low band. The bitstream may be transmitted and stored. The parameter necessary for bandwidth extension may include a quantization index of an envelope of a high band and refinement data of the high band.

A BWE scheme in the frequency domain may be applied by being combined with a time domain coding part. A code excited linear prediction (CELP) scheme may be mainly used for time domain coding, and the time domain coding may be implemented so as to code a low frequency band in the CELP scheme and be combined with the BWE scheme in the time domain other than the BWE scheme in the frequency domain. In this case, a coding scheme may be selectively applied for the entire coding, based on adaptive coding scheme determination between time domain coding and frequency domain coding. To select an appropriate coding scheme, signal classification is required, and according to an embodiment, an excitation class may be determined for each frame by preferentially using a result of the signal classification.

Figure 6:
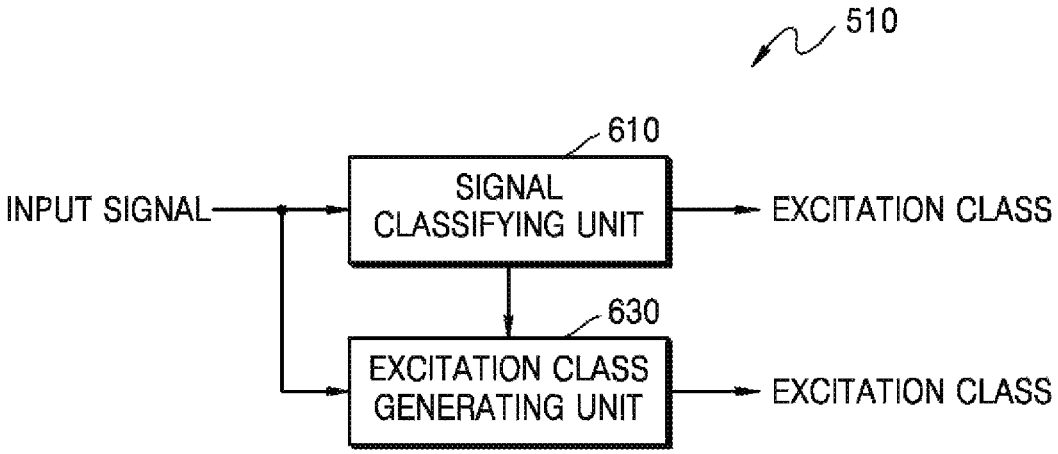
FIG. 6 is a block diagram of a bandwidth extension (BWE) parameter generating unit according to an exemplary embodiment.

FIG. 6 is a block diagram of the BWE parameter generating unit 510 of FIG. 5, according to an embodiment. The BWE parameter generating unit 510 may include a signal classifying unit 610 and an excitation class generating unit 630.

Referring to FIG. 6, the signal classifying unit 610 may classify whether a current frame is a speech signal by analyzing the characteristics of an input signal in units of frames, and may determine an excitation class according to a result of the classification. The signal classification may be performed using various well-known methods, e.g., by using short-term characteristics and/or long-term characteristics. The short-term characteristics and/or the long-term characteristics may be frequency domain characteristics and/or time domain characteristics. When a current frame is classified as a speech signal for which time domain coding is an appropriate coding scheme, a method of allocating a fixed-type excitation class may be more helpful for the improvement of sound quality than a method based on the characteristics of a high band signal. The signal classification may be performed on the current frame without taking into account a result of a classification with respect to a previous frame. In other words, even when the current frame by taking into account a hangover may be finally classified as a case that frequency domain coding is appropriate, a fixed excitation class may be allocated when the current frame itself is classified as a case that time domain coding is appropriate. For example, when the current frame is classified as a speech signal for which time domain coding is appropriate, the excitation class may be set to be a first excitation class related to speech characteristics.

When the current frame is not classified as a speech signal as a result of the classification of the signal classifying unit 610, the excitation class generating unit 630 may determine an excitation class by using at least one threshold. According to an embodiment, when the current frame is not classified as a speech signal as a result of the classification of the signal classifying unit 510, the excitation class generating unit 630 may determine an excitation class by calculating a tonality value of a high band and comparing the calculated tonality value with the threshold. A plurality of thresholds may be used according to the number of excitation classes. When a single threshold is used and the calculated tonality value is greater than the threshold, the current frame may be classified as a tonal music signal. On the other hand, when a single threshold is used and the calculated tonality value is smaller than the threshold, the current frame may be classified to a non-tonal music signal, for example, a noisy signal. When the current frame is classified as a tonal music signal, the excitation class may be determined as a second excitation class related to tonal characteristics. On the other hand, when the current frame is classified as a noisy signal, the excitation class may be determined as a third excitation class related to non-tonal characteristics.

Figure 7:
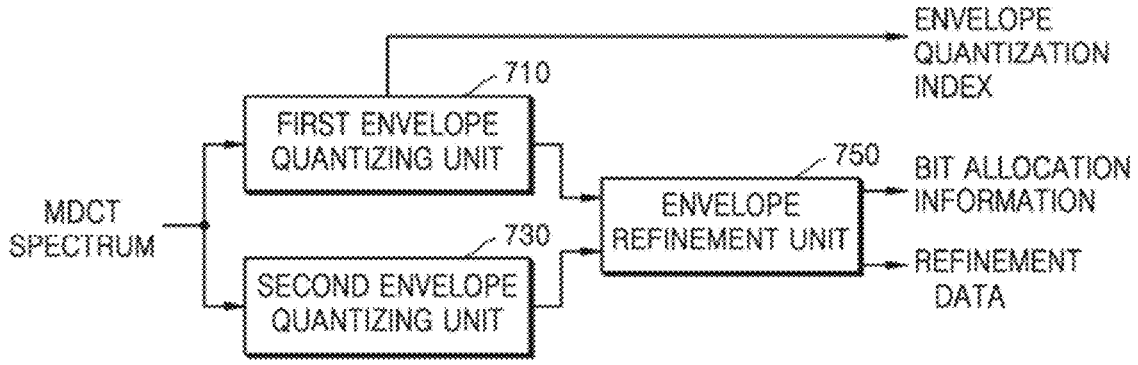
FIG. 7 is a block diagram of a high frequency coding apparatus, according to an exemplary embodiment.

FIG. 7 is a block diagram of a high band coding apparatus according to an exemplary embodiment.

The high band coding apparatus of FIG. 7 may include a first envelope quantizing unit 710, a second envelope quantizing unit 730 and an envelope refinement unit 750. The components may be integrated into at least one module and implemented by at least one processor (not shown).

Referring to FIG. 7, the first envelope quantizing unit 710 may quantize an envelope of a low band. According to an embodiment, the envelope of the low band may be vector quantized.

The second envelope quantizing unit 730 may quantize an envelope of a high band. According to an embodiment, the envelope of the high band may be vector quantized. According to an embodiment, an energy control may be performed on the envelope of the high band. In detail, an energy control factor may be obtained from a difference between tonality of a high band spectrum generated by an original spectrum and tonality of the original spectrum, the energy control may be performed on the envelope of the high band, based on the energy control factor, and the envelope of the high band on which the energy control is performed may be quantized.

As a result of quantization, a quantization index of the envelope of the high band may be included in a bitstream or be stored.

The envelope refinement unit 750 may generate bit allocation information for each sub-band, based on a full band envelope obtained from a low band envelope and a high band envelope, determine a sub-band for which it is necessary to update an envelope in a high band, based on the bit allocation information for each sub-band, and generate refinement data related to updating the envelope for the determined sub-band. The full band envelope may be obtained by mapping a band configuration of a high band envelope to a band configuration of a low band and combining a mapped high band envelope with the low band envelope. The envelope refinement unit 750 may determine a sub-band to which a bit is allocated in a high band as a sub-band for which envelope updating is performed and refinement data is transmitted. The envelope refinement unit 750 may update the bit allocation information based on bits used for representing the refinement data for the determined sub-band. Updated bit allocation information may be used for spectrum coding. The refinement data may comprise necessary bits, a minimum value, and a delta value of norms.

Figure 8:
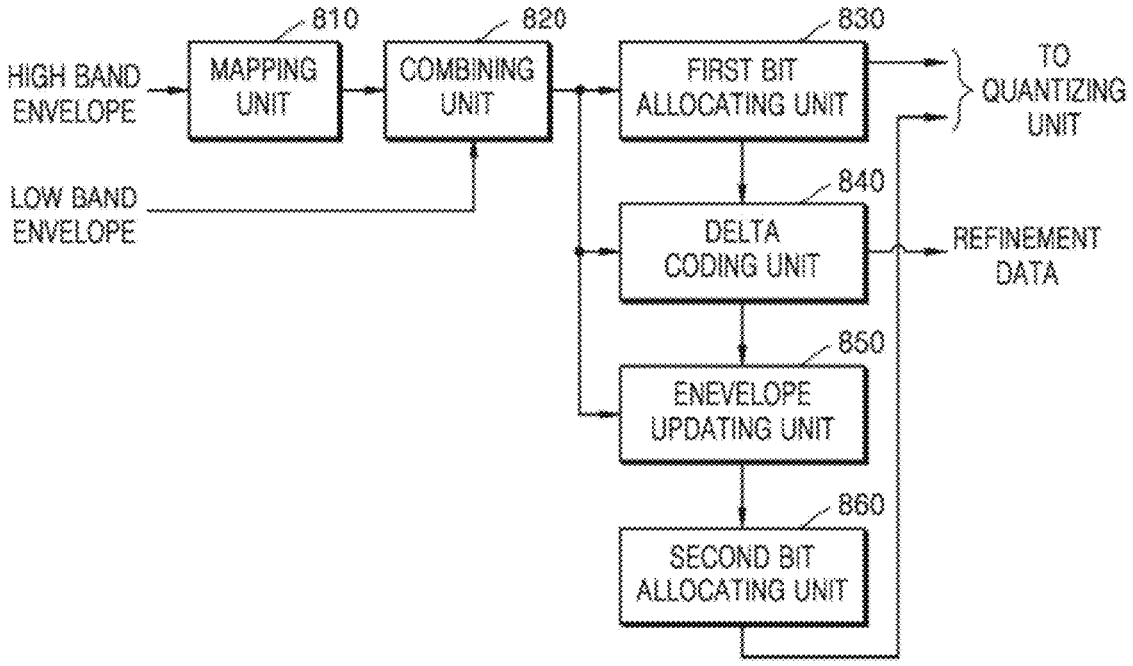
FIG. 8 is a block diagram of an envelope refinement unit in FIG. 7, according to an exemplary embodiment.

FIG. 8 shows a detailed block diagram of the envelope refinement unit 750 of FIG. 7 according to an exemplary embodiment.

The envelope refinement unit 730 of FIG. 8 may include a mapping unit 810, a combining unit 820, a first bit allocating unit 830, a delta coding unit 840, an envelope updating unit 850 and a second bit allocating unit 860. The components may be integrated into at least one module and implemented by at least one processor (not shown).

Referring to FIG. 8, the mapping unit 810 may map a high band envelope into a band configuration corresponding to the band division information of a full band, for frequency matching. According to embodiment, a quantized high band envelope provided from the second envelope quantizing unit 730 may be dequantized, and a mapped high band envelope may be obtained from the dequantized envelope. For convenience of explanation, a dequantized high band envelope is represented as $E'_q(p)$ and a mapped high band envelope is represented as $N_M(p)$. When a band configuration of a full band is identical to a band configuration of a high band, the quantized envelope $E_q(p)$ of the high band may be scalar quantized as it is. When a band configuration of a full band is different from a band configuration of a high band, it is necessary to map the quantized envelope $E_q(p)$ of the high band to a band configuration of a full band, i.e. a band configuration of a low band. This may be performed based on a number of spectral coefficients in each sub-band of a high band included in sub-bands of a low band. When there are some overlapping between a band configuration of a full band and a band configuration of a high band, a low frequency coding scheme may be set based on an overlapped band. As an example, the following mapping process may be performed.

$$N_M(30)=E'_q(1)$$

$$N_M(31)=\{E'_q(2)*2+E'_q(3)\}/3$$

$$N_M(32)=\{E'_q(3)*2+E'_q(4)\}/3$$

$$N_M(33)=\{E'_q(4)+E'_q(5)*2\}/3$$

$$N_M(34)=\{E'_q(5)+E'_q(6)*2\}/3$$

$$N_M(35)=E'_q(7)$$

$$N_M(36)=\{E'_q(8)*3+E'_q(9)\}/4$$

$$N_M(37)=\{E'_q(9)*3+E'_q(10)\}/4$$

$$N_M(38)=\{E'_q(10)+E'_q(11)*3\}/4$$

$$N_M(39)=E'_q(12)$$

$$N_M(40)=\{E'_q(12)+E'_q(13)*3\}/4$$

$$N_M(41)=\{E'_q(13)+E'_q(14)\}/2$$

$$N_M(42)=E'_q(14)$$

$$N_M(43)=E'_q(14)$$

The low band envelope may be obtained up to a sub-band, i.e. p=29 in which an overlap between a low frequency and a high frequency exists. The mapped envelope of the high band may be obtained up to a sub-band p=30~43. As an example, referring to tables 1 and 4, a case that an end frequency index is 639 means band allocation up to a super wide band (32K sampling rate) and a case that an end frequency index is 799 means band allocation up to a full band (48K sampling rate).

As above, the mapped envelope $N_M(p)$ of the high band may be again quantized. For this, scalar quantization may be used.

The combining unit 820 may combine a quantized low band envelope $N_q(p)$ with a mapped quantized high band envelope $N_M(p)$ to obtain a full band envelope $N_q(p)$.

The first bit allocating unit 830 may perform initial bit allocation for spectrum quantization in units of sub-bands, based on the full band envelope $N_q(p)$. In the initial bit allocation, based on norms obtained from the full band envelope, more bits may be allocated to a sub-band having a lager norm. Based on the initial bit allocation information, it may be determined whether or not the envelope refinement is required for the current frame. If there are any sub-bands which have allocated bits in the high band, delta coding needs to be done to refine the high frequency envelope. In other words, if there are any important spectral components in the high band, the refinement may be performed to provide a finer spectral envelope. In the high band, a sub-band to which a bit is allocated may be determined as a sub-band for which envelope updating is required. If there are no bits allocated to sub-bands in the high band during the initial bit allocation, the envelope refinement may not be required and the initial bit allocation may be used for spectrum coding and/or envelope coding of a low band. According to the initial bit allocation obtained from the first bit allocating unit 830, it may be determined whether or not the delta coding unit 840, the envelope updating unit 850 and the second bit allocating unit 860 operate. The first bit allocating unit 830 may perform fractional bit allocation.

The delta coding unit 840 may obtain deltas, i.e. differences between a mapped envelope $N_M(p)$ and a quantized envelope $N_q(p)$ from an original spectrum to then be coded, for a sub-band for which envelope updating is required. The deltas may be represented as equation 2.

$$D(p)=N_q(p)-N_M(p) \quad \text{[Equation 2]}$$

The delta coding unit 840 may calculate bits necessary for information transmission by checking a minimum value and a maximum value of the deltas. For example, when the maximum value is larger than 3 and smaller than 7, necessary bits may be determined as 4 bits and deltas from −8 to 7 may be transmitted. That is, a minimum value, min may be set to $-2^{(B-1)}$, a maximum value, max may be set to $2^{(B-1)}-1$ and B denotes necessary bits. Because there are some constraints when the necessary bits are represented, the minimum value and the maximum value may be limited when the necessary bits are represented while exceeding some constraints. The deltas may be recalculated by using the limited minimum value minl and the limited maximum value maxl as shown in Equation 3.

$$D_q(p)=\text{Max}(\text{Min}(D(p),\max l),\min l) \quad \text{[Equation 3]}$$

The delta coding unit 840 may generate norm update information, i.e. refinement data. According to an embodiment, the necessary bits may be represented by 2 bits and deltas may be included in a bitstream. Because the necessary bits may be represented by 2 bits, 4 cases may be represented. The necessary bits may be represented by 2 to 5 bits and 0, 1, 2, and 3 may be also utilized. By using a minimum value min, to-be-transmitted deltas may be calculated by $D_t(p)=D_q(p)-\min$. The refinement data may include the necessary bits, the minimum value and deltas.

The envelope updating unit 850 may update an envelope i.e. norms by using the deltas.

$$N_q(p)=N_M(p)+D_q(p) \quad \text{[Equation 4]}$$

The second bit allocating unit 860 may update the bit allocation information as many as bits used for representing the to-be-transmitted deltas. According to an embodiment, in order to provide enough bits in coding the deltas, while changing a band from a low frequency to a high frequency or from a high frequency to a low frequency during the initial bit allocation, when a sub-band was allocated more than specific bits, its allocation is reduced by one bit until all the bits required for the deltas have been accounted for. The updated bit allocation information may be used for spectrum quantization.

Figure 9:
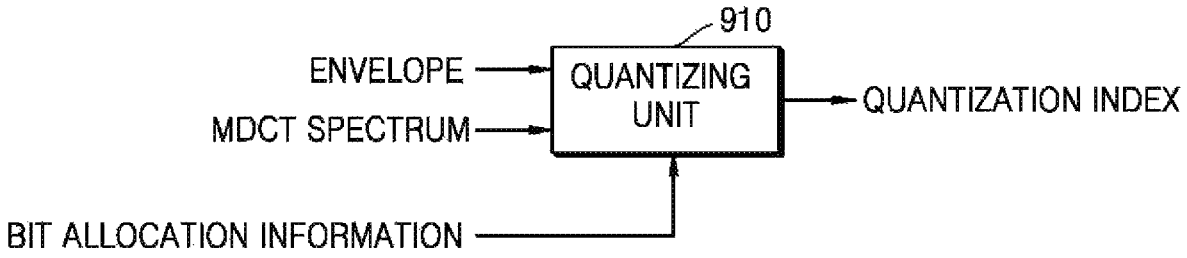
FIG. 9 is a block diagram of a low frequency coding apparatus in FIG. 5, according to an exemplary embodiment.

FIG. 9 shows a block diagram of a low frequency coding apparatus of FIG. 5 and may include a quantization unit 910.

Referring to FIG. 9, the quantization unit 910 may perform spectrum quantization based on the bit allocation information provided from the first bit allocation unit 830 or the second bit allocation unit 860. According to an embodiment, pyramid vector quantization (PVQ) may be used for the quantization, but embodiments are not limited thereto. The quantization unit 910 may perform normalization based on the updated envelope, i.e. the updated norms and perform quantization on the normalized spectrum. During spectrum quantization, a noise level required for noise filling in a decoding end may be calculated to then be coded.

Figure 10:
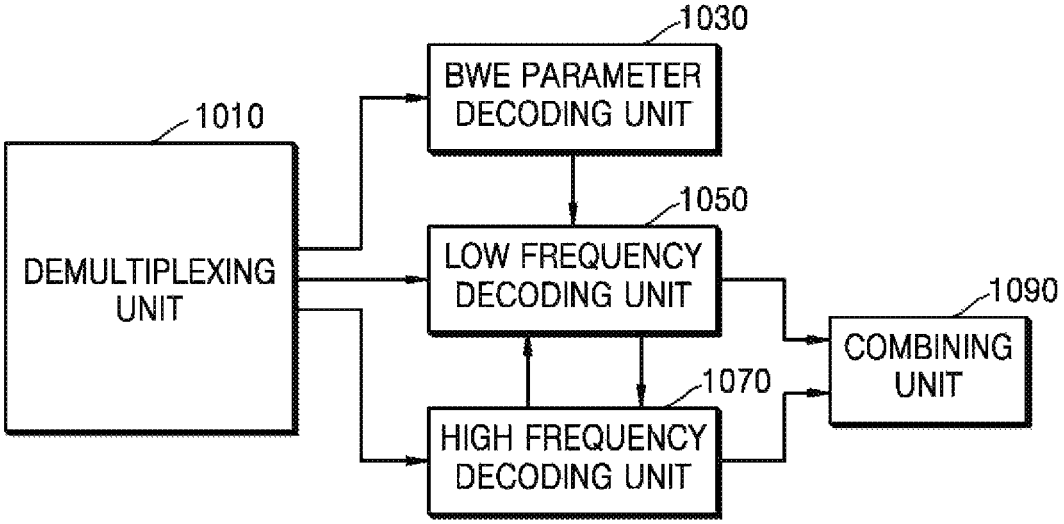
FIG. 10 is a block diagram of an audio decoding apparatus according to an exemplary embodiment.

FIG. 10 shows a block diagram of an audio decoding apparatus according to an embodiment.

The audio decoding apparatus of FIG. 10 may comprise a demultiplexing unit 1010, a BWE parameter decoding unit 1030, a high frequency decoding unit 1050, a low frequency decoding unit 1070 and a combining unit 1090. Although not shown in FIG. 10, the audio decoding apparatus may further include an inverse transform unit. The components may be integrated into at least one module and implemented by at least one processor (not shown). An input signal may indicate music, speech, or a mixed signal of music and speech and may be largely divided into a speech signal and another general signal. Hereinafter, the input signal is referred to as an audio signal for convenience of description.

Referring to FIG. 10, the demultiplexing unit 610 may parse a received bitstream to generate a parameter necessary for decoding.

The BWE parameter decoding unit 1030 may decode a BWE parameter included in the bistream. The BWE parameter may correspond to an excitation class. According to another embodiment, the BWE parameter may include an excitation class and other parameters.

The high frequency decoding unit 1050 may generate a high frequency excitation spectrum by using the decoded low frequency spectrum and an excitation class. According to another embodiment, the high frequency decoding unit 1050 may decode a parameter necessary for bandwidth extension or bit allocation included in the bistream and may apply the parameter necessary for bandwidth extension or bit allocation and the decoded information related to an energy of the decoded low band signal to the high frequency excitation spectrum.

The parameter necessary for bandwidth extension may include information related to the energy of a high band signal and additional information. The additional information may correspond to information about a band including an important spectral component in a high band, and may be information related to a spectral component included in a specific band of the high band. The information related to the energy of the high band signal may be vector-dequantized.

The low frequency decoding unit 1070 may generate a low frequency spectrum by decoding an encoded spectral coefficient of a low band. The low frequency decoding unit 1070 may also decode information related to an energy of a low band signal.

The combining unit 1090 may combine the spectrum provided from the low frequency decoding unit 1070 with the spectrum provided from the high frequency decoding unit 1050. The inverse transform unit (not shown) may inversely transform a combined spectrum obtained from the spectrum combination into a time domain signal. Inverse MDCT (IMDCT) may be used for the domain inverse-transform, but embodiments are not limited thereto.

Figure 11:
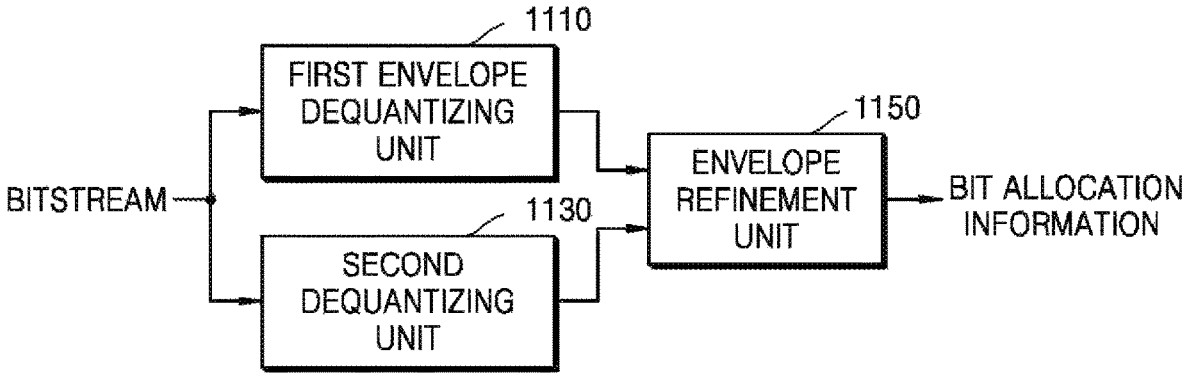
FIG. 11 is a part of elements in a high frequency decoding unit according to an exemplary embodiment.

FIG. 11 is a block diagram of a partial configuration of a high frequency decoding unit 1050 according to an embodiment.

The high frequency decoding unit 1050 of FIG. 11 may include a first envelope dequantizing unit 1110, a second envelope dequantizing unit 1130, and an envelope refinement unit 1150. The components may be integrated into at least one module to implement at least one processor (not shown).

Referring to FIG. 11, the first envelope dequantizing unit 1110 may dequantize a low band envelope. According to an embodiment, the low band envelope may be vector dequantized.

The second envelope dequantizing unit 1130 may dequantize a high band envelope. According to an embodiment, the high band envelope may be vector dequantized.

The envelope refinement unit 1150 may generate bit allocation information for each sub-band based on a full band envelope obtained from the low band envelope and the high band envelope, determine a sub-band requiring envelope updating in a high band based on the bit allocation information for each sub-band, decode refinement data related to the envelope updating for the determined sub-band, and update the envelope. In this regard, the full band envelope may be obtained by mapping a band configuration of the high band envelope into a band configuration of the low band envelope and combining the mapped high band envelope and low band envelope. The envelope refinement unit 1150 may determine a sub-band in which a bit is allocated in a high band as the sub-band for which the envelope updating is required and the refinement data is decoded. The envelope refinement unit 1150 may update the bit allocation information based on the number of bits used to express the refinement data with respect to the determined sub band. The updated bit allocation information may be used for spectrum decoding. The refinement data may include necessary bits, a minimum value, and a delta value of norms.

Figure 12:
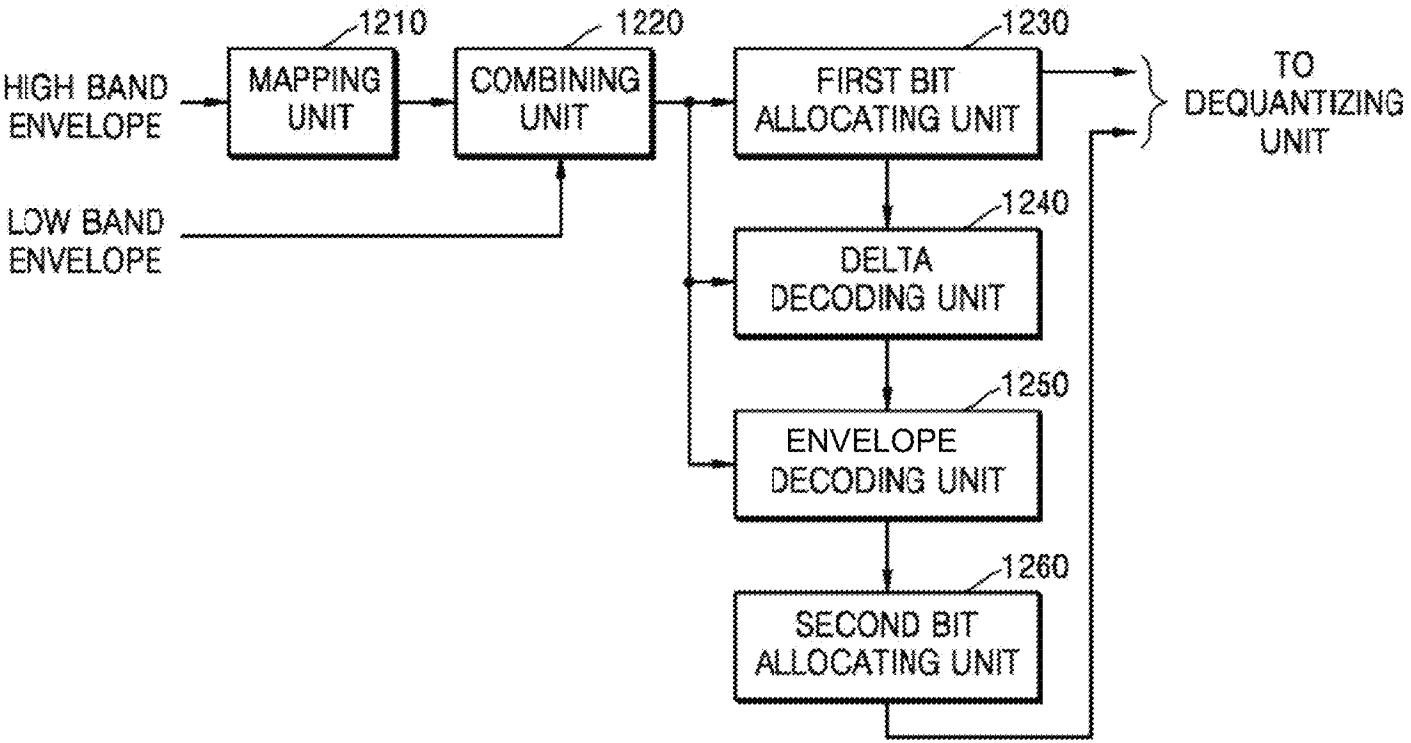
FIG. 12 is a block diagram of an envelope refinement unit in FIG. 11, according to an exemplary embodiment.

FIG. 12 is a block diagram of the envelope refinement unit 1150 of FIG. 11 according to an embodiment.

The envelope refinement unit 1150 of FIG. 12 may include a mapping unit 1210, a combining unit 1220, a first bit allocating unit 1230, a delta decoding unit 1240, an envelope updating unit 1250 and a second bit allocating unit 1260. The components may be integrated into at least one module and implemented by at least one processor (not shown).

Referring to FIG. 12, the mapping unit 1210 may map a high band envelope into a band configuration corresponding to the band division information of a full band, for frequency matching. The mapping unit 1210 may operate in the same manner as the mapping unit 810 of FIG. 8.

The combining unit 1220 may combine a dequantized low band envelope $N_q(p)$ with a mapped dequantized high band envelope $N_M(p)$ to obtain a full band envelope $N_q(p)$. The combining unit 1220 may operate in the same manner as the combining unit 820 of FIG. 8.

The first bit allocating unit 1230 may perform initial bit allocation for spectrum dequantization in units of sub-band, based on the full band envelope $N_q(p)$. The first bit allocating unit 1230 may operate in the same manner as the first bit allocating unit 830 of FIG. 8.

The delta decoding unit 1240 may determine whether envelope updating is required and determine a sub-band for which the envelope updating is required, based on the bit allocation information. For the determined sub-band, update information, i.e. refinement data transmitted from an encoding end may be decoded. According to an embodiment, necessary bits, 2 bits, from refinement data represented as Delta (0), Delta (1), etc. may be extracted and then a minimum value may be calculated to extract deltas $D_q(p)$. Because 2 bits are used for the necessary bits, 4 cases may be represented. Because up to 2 to 5 bits may be represented by using 0, 1, 2 and 3 respectively, for example, in a case of 0, 2 bits or in a case of 3, 5 bits may be set as the necessary bits. Depending to the necessary bits, the minimum value min may be calculated and then $D_q(p)$ may be extracted by $D_q(p)=D_t(p)+\min$, based on the minimum value.

The envelope updating unit 1250 may update an envelope i.e. norms based on the extracted deltas $D_q(p)$. The envelope updating unit 1250 may operate in the same manner as the envelope updating unit 850 of FIG. 8.

The second bit allocating unit 1260 may again obtain bit allocation information as many as bits used for representing the extracted deltas. The second bit allocating unit 1260 may operate in the same manner as the second bit allocating unit 860 of FIG. 8.

The updated envelope and the final bit allocation information obtained by the second bit allocating unit 1260 may be provided to the low frequency decoding unit 1070.

Figure 13:
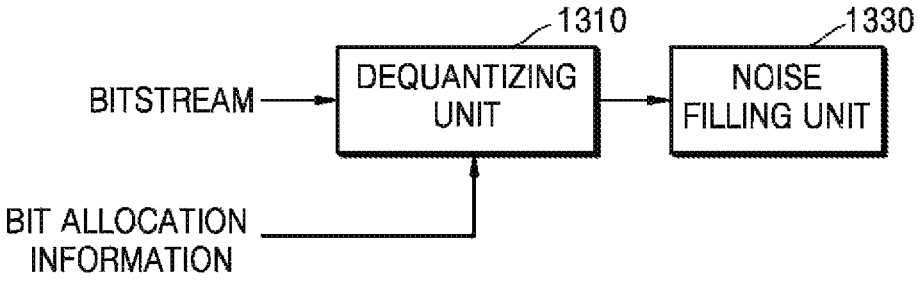
FIG. 13 is a block diagram of a low frequency decoding apparatus in FIG. 10, according to an exemplary embodiment.

FIG. 13 is a block diagram of a low frequency decoding apparatus of FIG. 10 and may include a dequantizing unit 1310 and a noise filling unit 1350.

Referring to FIG. 13, the dequantizing unit 1310 may dequantize a spectrum quantization index included in a bitstream, based on bit allocation information. As a result, a low band spectrum and a partial important spectrum in a high band may be generated.

The noise filling unit 1350 may perform a noise filling process with respect to a dequantized spectrum. The noise filling process may be performed on a low band. The noise filling process may be performed on a sub-band dequantized to all zero or a sub-band to which average bits smaller than a predetermined value are allocated, in the dequantized spectrum. The noise filled spectrum may be provided to the combining unit 1090 of FIG. 10. In addition, a denormailzation process may be performed on the noise filled spectrum, based on the updated envelope. An anti-sparseness process may also be performed on the spectrum generated by the noise filling unit 1330 and an amplitude of the anti-sparseness processed spectrum may be adjusted based on an excitation class so as to then generate a high frequency spectrum. In the anti-sparseness process, a signal having a random sign and a certain value of amplitude may be inserted into a coefficient portion remaining as zero within the noise filled spectrum.

Figure 14:
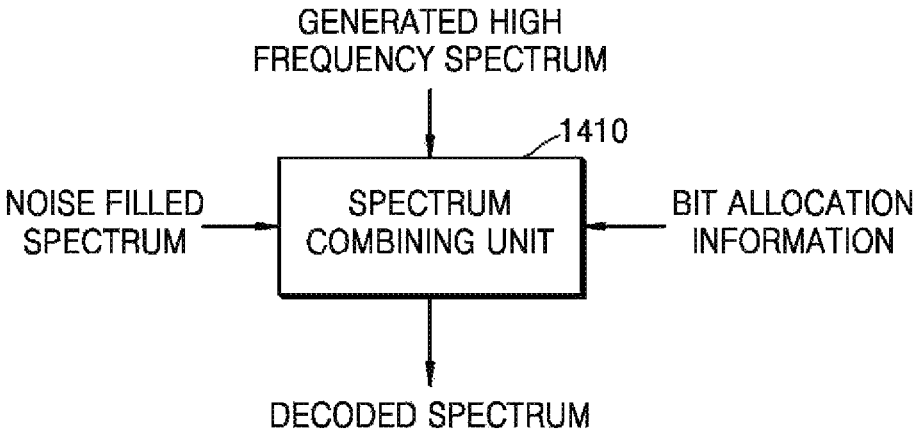
FIG. 14 is a block diagram of a combining unit in FIG. 10, according to an exemplary embodiment.

FIG. 14 is a block diagram of a combining unit 1090 of FIG. 10 and may include a spectrum combining unit 1410.

Referring to FIG. 14, the spectrum combining unit 1410 may combine the decoded low band spectrum and the generated high band spectrum. The low band spectrum may be the noise filled spectrum. The high band spectrum may be generated by using a modified low band spectrum which is obtained by adjusting a dynamic range or an amplitude of the decoded low band spectrum based on an excitation class. For example, the high band spectrum may be generated by patching, for example, transposing, copying, mirroring, or folding, the modified low frequency spectrum to a high band.

The spectrum combining unit 1410 may selectively combine the decoded low band spectrum and the generated high band spectrum, based on the bit allocation information provided from the envelope refinement unit 110. The bit allocation information may be the initial bit allocation information or the final bit allocation information. According to an embodiment, when a bit is allocated to a sub-band located at a boundary of low band and a high band, combining may be performed based on the noise filled spectrum, whereas when a bit is not allocated to a sub-band located at a boundary of low band and a high band, an overlap and add process may be performed on the noise filled spectrum and the generated high band spectrum.

The spectrum combining unit 1410 may use the noise filled spectrum in a case of a sub-band with bit allocation and may use the generated high band spectrum in a case of a sub-band without bit allocation. The sub-band configuration may correspond to a band configuration of a full band.

Figure 15:
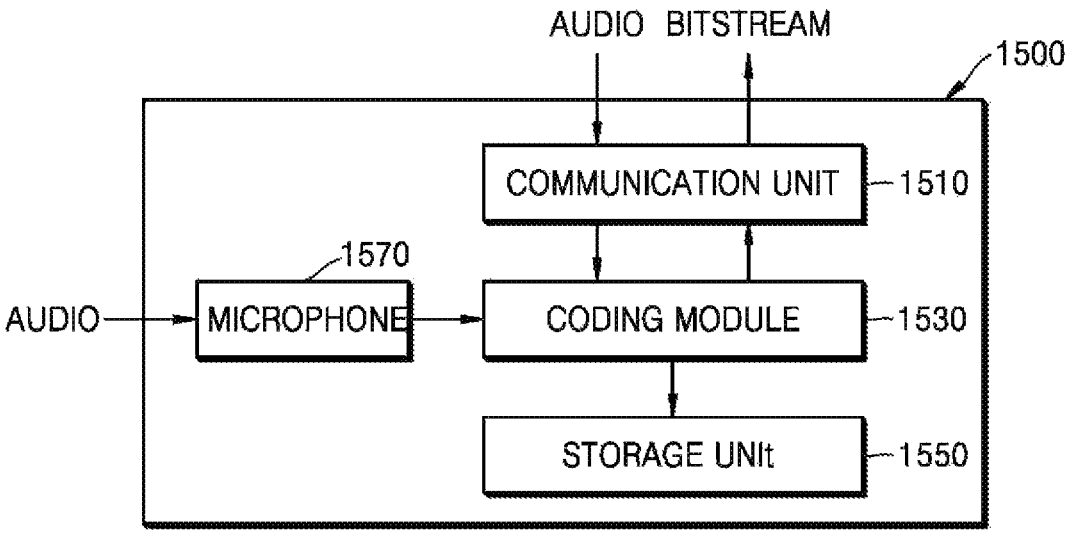
FIG. 15 is a block diagram of a multimedia apparatus including a coding module, according to an exemplary embodiment.

FIG. 15 is a block diagram of a multimedia device including an encoding module, according to an exemplary embodiment.

Referring to FIG. 15, the multimedia device 1500 may include a communication unit 1510 and the coding module 1530. In addition, the multimedia device 1500 may further include a storage unit 1550 for storing an audio bitstream obtained as a result of encoding according to the usage of the audio bitstream. Moreover, the multimedia device 1500 may further include a microphone 1570. That is, the storage unit 1550 and the microphone 1570 may be optionally included. The multimedia device 1500 may further include an arbitrary decoding module (not shown), e.g., a decoding module for performing a general decoding function or a decoding module according to an exemplary embodiment. The coding module 1530 may be implemented by at least one processor (not shown) by being integrated with other components (not shown) included in the multimedia device 1500 as one body.

The communication unit 1510 may receive at least one of an audio signal or an encoded bitstream provided from the outside or may transmit at least one of a reconstructed audio signal or an encoded bitstream obtained as a result of encoding in the encoding module 1530.

The communication unit 1510 is configured to transmit and receive data to and from an external multimedia device or a server through a wireless network, such as wireless Internet, wireless intranet, a wireless telephone network, a wireless Local Area Network (LAN), Wi-Fi, Wi-Fi Direct (WFD), third generation (3G), fourth generation (4G), Bluetooth, Infrared Data Association (IrDA), Radio Frequency Identification (RFID), Ultra WideBand (UWB), Zigbee, or Near Field Communication (NFC), or a wired network, such as a wired telephone network or wired Internet.

According to an exemplary embodiment, the coding module 1530 may transform a time domain audio signal provided through the communication unit 1510 or the microphone 1570 into a frequency domain audio signal, generate bit allocation information for each sub-band, based on an envelope of a full band obtained from the frequency domain audio signal, determine a sub-band for which it is necessary to update an envelope in a high band, based on the bit allocation information for each sub-band, and generate refinement data related to envelope updating for the determined sub-band.

The storage unit 1550 may store the encoded bitstream generated by the coding module 1530. In addition, the storage unit 1550 may store various programs required to operate the multimedia device 1500.

The microphone 1570 may provide an audio signal from a user or the outside to the encoding module 1530.

Figure 16:
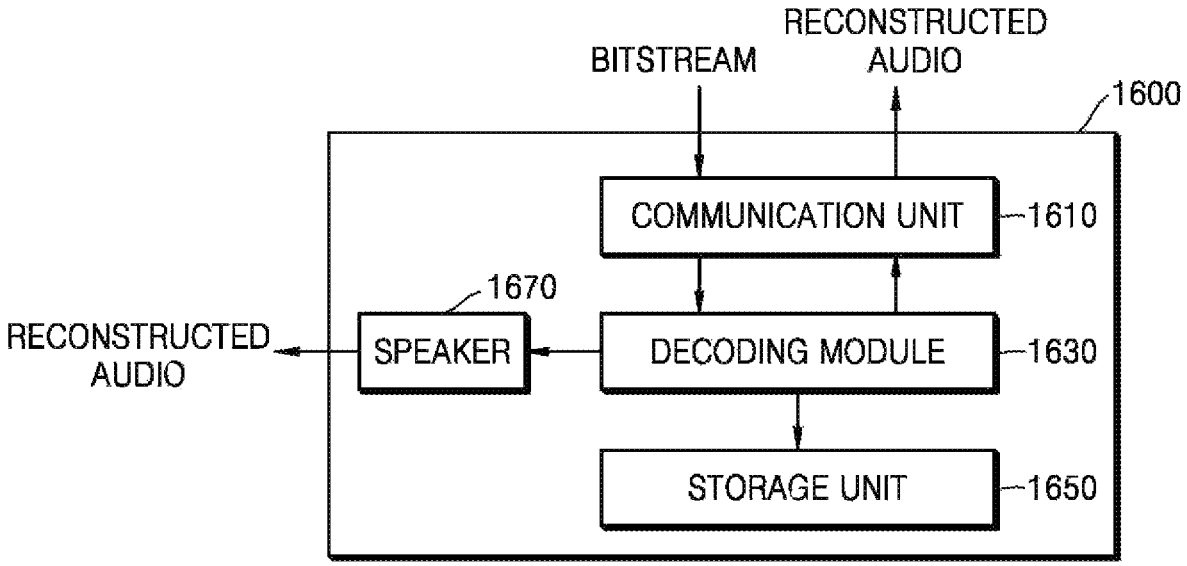
FIG. 16 is a block diagram of a multimedia apparatus including a decoding module, according to an exemplary embodiment.

FIG. 16 is a block diagram of a multimedia device including a decoding module, according to an exemplary embodiment.

Referring to FIG. 16, the multimedia device 1600 may include a communication unit 1610 and a decoding module 1630. In addition, according to the usage of a reconstructed audio signal obtained as a result of decoding, the multimedia device 1600 may further include a storage unit 1650 for storing the reconstructed audio signal. In addition, the multimedia device 1600 may further include a speaker 1670. That is, the storage unit 1650 and the speaker 1670 may be optionally included. The multimedia device 1600 may further include an encoding module (not shown), e.g., an encoding module for performing a general encoding function or an encoding module according to an exemplary embodiment. The decoding module 1630 may be implemented by at least one processor (not shown) by being integrated with other components (not shown) included in the multimedia device 1600 as one body.

The communication unit 1610 may receive at least one of an audio signal or an encoded bitstream provided from the outside or may transmit at least one of a reconstructed audio signal obtained as a result of decoding in the decoding module 1630 or an audio bitstream obtained as a result of encoding. The communication unit 1610 may be implemented substantially and similarly to the communication unit 1510 of FIG. 15.

According to an exemplary embodiment, the decoding module 1630 may receive a bitstream provided through the communication unit 1610, generate bit allocation information for each sub-band, based on an envelope of a full band, determine a sub-band for which it is necessary to update an envelope in a high band, based on the bit allocation information for each sub-band, and update the envelope by decoding refinement data related to envelope updating for the determined sub-band.

The storage unit 1650 may store the reconstructed audio signal generated by the decoding module 1630. In addition, the storage unit 1650 may store various programs required to operate the multimedia device 1600.

The speaker 1670 may output the reconstructed audio signal generated by the decoding module 1630 to the outside.

Figure 17:
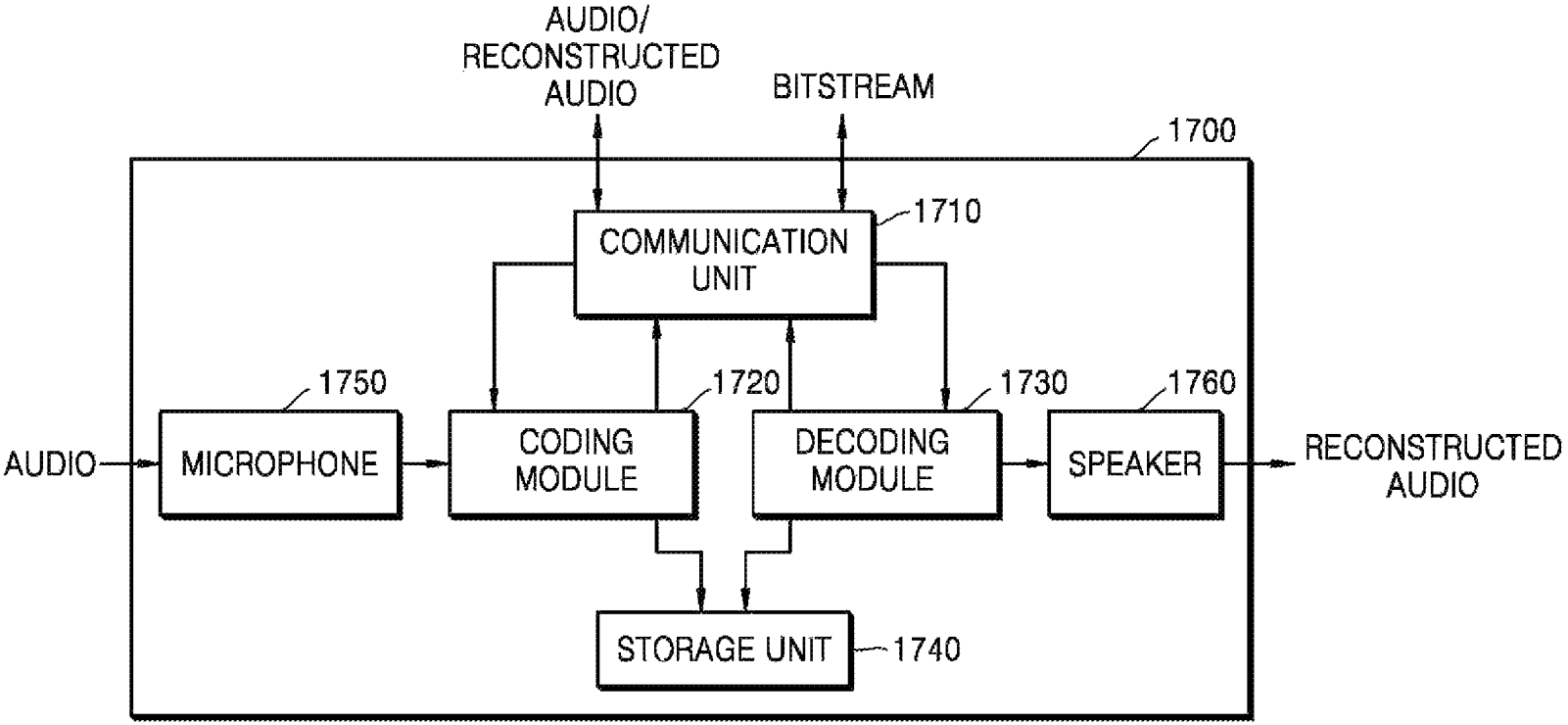
FIG. 17 is a block diagram of a multimedia apparatus including a coding module and a decoding module, according to an exemplary embodiment.

FIG. 17 is a block diagram of a multimedia device including an encoding module and a decoding module, according to an exemplary embodiment.

Referring to FIG. 17, the multimedia device 1700 may include a communication unit 1710, a coding module 1720, and a decoding module 1730. In addition, the multimedia device 1700 may further include a storage unit 1740 for storing an audio bitstream obtained as a result of encoding or a reconstructed audio signal obtained as a result of decoding according to the usage of the audio bitstream or the reconstructed audio signal. In addition, the multimedia device 1700 may further include a microphone 1750 and/or a speaker 1760. The coding module 1720 and the decoding module 1730 may be implemented by at least one processor (not shown) by being integrated with other components (not shown) included in the multimedia device 1700 as one body.

Since the components of the multimedia device 1700 shown in FIG. 17 correspond to the components of the multimedia device 1500 shown in FIG. 15 or the components of the multimedia device 1600 shown in FIG. 16, a detailed description thereof is omitted.

Each of the multimedia devices 1500, 1600, and 1700 shown in FIGS. 15, 16, and 17 may include a voice communication dedicated terminal, such as a telephone or a mobile phone, a broadcasting or music dedicated device, such as a TV or an MP3 player, or a hybrid terminal device of a voice communication dedicated terminal and a broadcasting or music dedicated device but are not limited thereto. In addition, each of the multimedia devices 1500, 1600, and 1700 may be used as a client, a server, or a transducer displaced between a client and a server.

When the multimedia device 1500, 1600, and 1700 is, for example, a mobile phone, although not shown, the multimedia device 1500, 1600, and 1700 may further include a user input unit, such as a keypad, a display unit for displaying information processed by a user interface or the mobile phone, and a processor for controlling the functions of the mobile phone. In addition, the mobile phone may further include a camera unit having an image pickup function and at least one component for performing a function required for the mobile phone.

When the multimedia device 1500, 1600, and 1700 is, for example, a TV, although not shown, the multimedia device 1500, 1600, or 1700 may further include a user input unit, such as a keypad, a display unit for displaying received broadcasting information, and a processor for controlling all functions of the TV. In addition, the TV may further include at least one component for performing a function of the TV.

Figure 18:
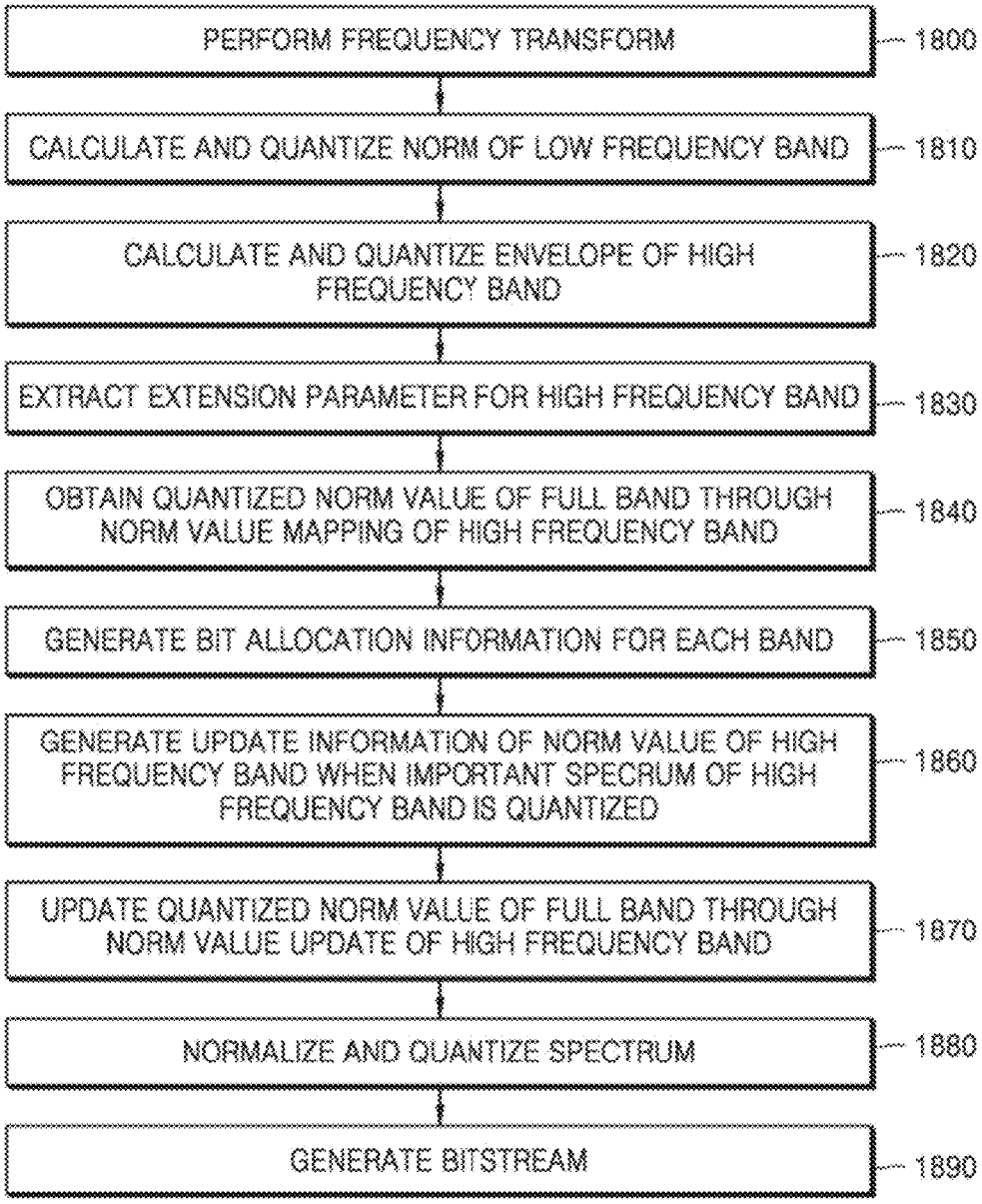
FIG. 18 is a flowchart of an audio coding method according to an exemplary embodiment.

FIG. 18 is a flowchart of an audio coding method according to an exemplary embodiment. The audio coding method of FIG. 18 may be performed by a corresponding element in FIGS. 5 to 9 or may be performed by a special processor.

Referring to FIG. 18, in operation 1810, a time-frequency transform such as an MDCT may be performed on an input signal.

In operation 1810, norms of a low frequency band may be calculated from the MDCT spectrum and then be quantized.

In operation 1820, an envelope of a high frequency band may be calculated from the MDCT spectrum and then be quantized.

In operation 1830, an extension parameter of the high frequency band may be extracted.

In 1840, quantized norm values of a full band may be obtained through norm value mapping of the high frequency band.

In 1850, bit allocation information for each band may be generated.

In 1860, when important spectral information of the high frequency band is quantized based on the bit allocation information for each band, information on updating norms of the high frequency band may be generated.

In 1870, by updating norms of the high frequency band, quantized norm values of the full band may be updated.

In 1880, a spectrum may be normalized and then quantized based on the updated quantized norm values of the full band.

In 1890, a bitstream including the quantized spectrum may be generated.

Figure 19:
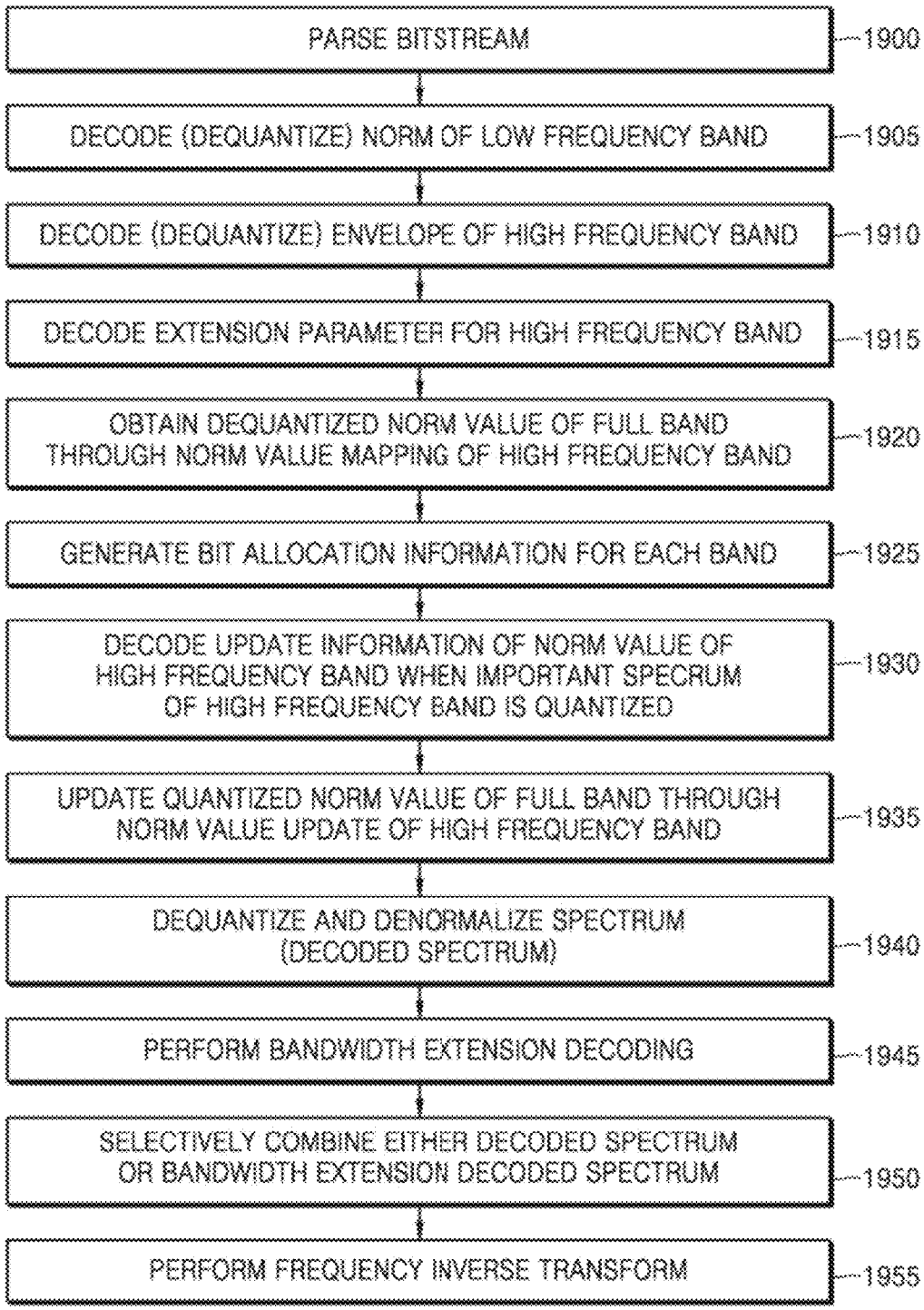
FIG. 19 is a flowchart of an audio decoding method according to an exemplary embodiment.

FIG. 19 is a flowchart of an audio decoding method according to an exemplary embodiment. The audio decoding method of FIG. 19 may be performed by a corresponding element in FIGS. 10 to 14 or may be performed by a special processor.

Referring to FIG. 19, in operation 1900, a bitstream may be parsed.

In operation 1905, norms of a low frequency band included in the bitstream may be decoded.

In operation 1910, an envelope of a high frequency band included in the bitstream may be decoded.

In operation 1915, an extension parameter of the high frequency band may be decoded.

In operation 1920, dequantized norm values of a full band may be obtained through norm value mapping of the high frequency band.

In operation 1925, bit allocation information for each band may be generated.

In operation 1930, when important spectral information of the high frequency band is quantized based on the bit allocation information for each band, information on updating norms of the high frequency band may be decoded.

In operation 1935, by updating norms of the high frequency band, quantized norm values of the full band may be updated.

In operation 1940, a spectrum may be dequantized and then denormalized based on the updated quantized norm values of the full band.

In operation 1945, a bandwidth extension decoding may be performed based on the decoded spectrum.

In operation 1950, either the decoded spectrum or the bandwidth extension decoded spectrum may be selectively combined.

In operation 1955, a time-frequency inverse transform such as an IMDCT may be performed on the selectively combined spectrum.

The methods according to the embodiments may be edited by computer-executable programs and implemented in a general-use digital computer for executing the programs by using a computer-readable recording medium. In addition, data structures, program commands, or data files usable in the embodiments of the present invention may be recorded in the computer-readable recording medium through various means. The computer-readable recording medium may include all types of storage devices for storing data readable by a computer system. Examples of the computer-readable recording medium include magnetic media such as hard discs, floppy discs, or magnetic tapes, optical media such as compact disc-read only memories (CD-ROMs), or digital versatile discs (DVDs), magneto-optical media such as floptical discs, and hardware devices that are specially configured to store and carry out program commands, such as ROMs, RAMs, or flash memories. In addition, the computer-readable recording medium may be a transmission medium for transmitting a signal for designating program commands, data structures, or the like. Examples of the program commands include a high-level language code that may be executed by a computer using an interpreter as well as a machine language code made by a compiler.

Although the embodiments of the present invention have been described with reference to the limited embodiments and drawings, the embodiments of the present invention are not limited to the embodiments described above, and their updates and modifications could be variously carried out by those of ordinary skill in the art from the disclosure. Therefore, the scope of the present invention is defined not by the above description but by the claims, and all their uniform or equivalent modifications would belong to the scope of the technical idea of the present invention.

The invention claimed is:

1. A method for encoding an audio signal, the method comprising:

generating a mapped envelope of a high band by mapping an envelope of the high band into a band configuration of a full band;

generating an envelope of the full band by combining the mapped envelope of the high band with an envelope of a low band;

generating bit allocation information for a sub-band based on the envelope of the full band;

determining to perform envelope refinement if there is any sub-band to which a bit is allocated in the high band based on the bit allocation information;

in response to determining to perform the envelope refinement, generating refinement data for the sub-band to which the bit is allocated in the high band, updating the mapped envelope by using the refinement data, updating the bit allocation information based on bits used for the envelope refinement for the sub-band to which the bit is allocated, and generating a bitstream including the refinement data.

2. The method of claim 1, further comprising generating an excitation class based on signal characteristics of the high band and encoding the excitation class.

3. The method of claim 1, wherein the updated bit allocation information is provided to be used for spectrum coding.

4. The method of claim 1, wherein the generating of the refinement comprises calculating a delta of norm, which is a difference between the mapped envelope and an envelope from an original spectrum, by using a maximum limit and a minimum limit.

5. The method of claim 4, wherein generating of the bitstream comprises generating the bitstream including necessary bits for representing the delta of norm and a value of the delta of norm.

6. A method for decoding an audio signal, the method comprising:

generating a mapped envelope of a high band by mapping an envelope of the high band into a band configuration of a full band;

generating an envelope of the full band by combining the mapped envelope of the high band with an envelope of a low band;

generating bit allocation information for a sub-band based on the envelope of the full band;

determining to perform updating the envelope if there is any sub-band in which a bit is allocated in the high band based on the bit allocation information; and in response to determining to perform the updating the envelope, decoding refinement data for the sub-band to which the bit is allocated in the high band, and updating the envelope by using the refinement data, and updating the bit allocation information based on bits used for envelope refinement for the sub-band to which the bit is allocated.

7. The method of claim 6, further comprising decoding an excitation class.

8. The method of claim 6, the updated bit allocation information is provided to be used for spectrum decoding.

9. The method of claim 6, wherein decoding of the refinement data comprises decoding necessary bits for representing a delta of norm and a value of the delta of norm, wherein the delta of norm is a difference between the mapped envelope and an envelope from an original spectrum.

10. An apparatus for encoding an audio signal, the apparatus comprising:

at least one processor configured to:

generate a mapped envelope of a high band by mapping an envelope of the high band into a band configuration of a full band;

generate an envelope of the full band by combining the mapped envelope of the high band with an envelope of a low band;

generate bit allocation information for a sub-band based on the envelope of the full band;

determine to perform envelope refinement if there is any sub-band to which a bit is allocated in the high band based on the bit allocation information;

in response to determining to perform the envelope refinement, generate refinement data for the sub-band to which the bit is allocated in the high band, update the mapped envelope by using the refinement data, update the bit allocation information based on bits used for the envelope refinement for the sub-band to which the bit is allocated, and generate a bitstream including the refinement data.

11. An apparatus for decoding an audio signal, the apparatus comprising:

at least one processor configured to:

generate a mapped envelope of a high band by mapping an envelope of the high band into a band configuration of a full band;

generate an envelope of the full band by combining the mapped envelope of the high band with an envelope of a low band;

generate bit allocation information for a sub-band based on the envelope of the full band;

determine to perform updating the envelope if there is any sub-band in which a bit is allocated in the high band based on the bit allocation information; and in response to determining to perform the updating the envelope, decode refinement data for the sub-band to which the bit is allocated in the high band, update the envelope by using the refinement data, and update the bit allocation information based on bits used for envelope refinement for the sub-band to which the bit is allocated.

* * * * *